US005579921A

United States Patent [19]

Mallant et al.

[11] Patent Number: 5,579,921

[45] Date of Patent: Dec. 3, 1996

[54] OPTICAL SORTING SYSTEM FOR A COLOR SORTING MACHINE AND PROCESS

[75] Inventors: Jos P. Mallant, Hamburg; Rainer Schumann; Thomas Moritz, both of Berlin; Harald C. Justus, Reinbek, all of Germany

[73] Assignee: Elexso Sortiertechnik GmbH, Hamburg, Germany

[21] Appl. No.: 952,240

[22] Filed: Sep. 28, 1992

[30] Foreign Application Priority Data

Sep. 30, 1991 [DE] Germany ..... 41 32 472.2

[51] Int. Cl.[6] ..... B07C 5/342

[52] U.S. Cl. ..... 209/580; 209/587; 209/938; 356/342; 250/226

[58] Field of Search ..... 209/576, 577, 209/578, 580, 581, 582, 585, 587, 908, 938; 250/223 R, 226; 356/419, 425, 448, 342

[56] References Cited

U.S. PATENT DOCUMENTS

| | | | |
|---|---|---|---|
| 3,785,735 | 1/1974 | Friedman et al. | 356/342 X |
| 3,993,899 | 11/1976 | Chapman | 250/226 X |
| 4,057,146 | 11/1977 | Castaneda et al. | 250/226 X |
| 4,235,342 | 11/1980 | Braham | 209/581 X |
| 4,348,111 | 9/1982 | Goulas et al. | 356/342 X |
| 4,350,442 | 9/1982 | Arild et al. | 209/587 X |
| 4,454,029 | 6/1984 | Codding | 209/581 |
| 4,697,709 | 10/1987 | Codding | 209/581 X |
| 4,699,274 | 10/1987 | Saika | 209/587 |
| 4,799,596 | 1/1989 | Mallant | 209/580 |
| 4,807,762 | 2/1989 | Illy et al. | 209/580 |
| 4,863,041 | 9/1989 | Bailey | 209/587 X |
| 4,878,582 | 11/1989 | Codding | 209/580 |
| 5,158,181 | 10/1992 | Bailey | 209/587 X |

FOREIGN PATENT DOCUMENTS

| | | | |
|---|---|---|---|
| 0044014 | 1/1982 | European Pat. Off. | 209/581 |
| 0130715 | 1/1985 | European Pat. Off. . | |
| 0146299 | 6/1985 | European Pat. Off. . | |
| 3203773 | 8/1983 | Germany . | |
| 3406599 | 10/1984 | Germany . | |
| 2091416 | 7/1982 | United Kingdom . | |

*Primary Examiner*—William E. Terrell
*Assistant Examiner*—Tuan N. Nguyen
*Attorney, Agent, or Firm*—Foley & Lardner

[57] ABSTRACT

The invention relates to an optical sorting system for a color sorting machine. Product is irradiated with visible, infra-red or ultra-violet light by a transmitter. If there is no product in the ray path of the transmission source, all of the light falls onto a residual light receiver. If product is present, on the other hand, the light is partly or wholly scattered back to one or more product signal receivers.

16 Claims, 1 Drawing Sheet

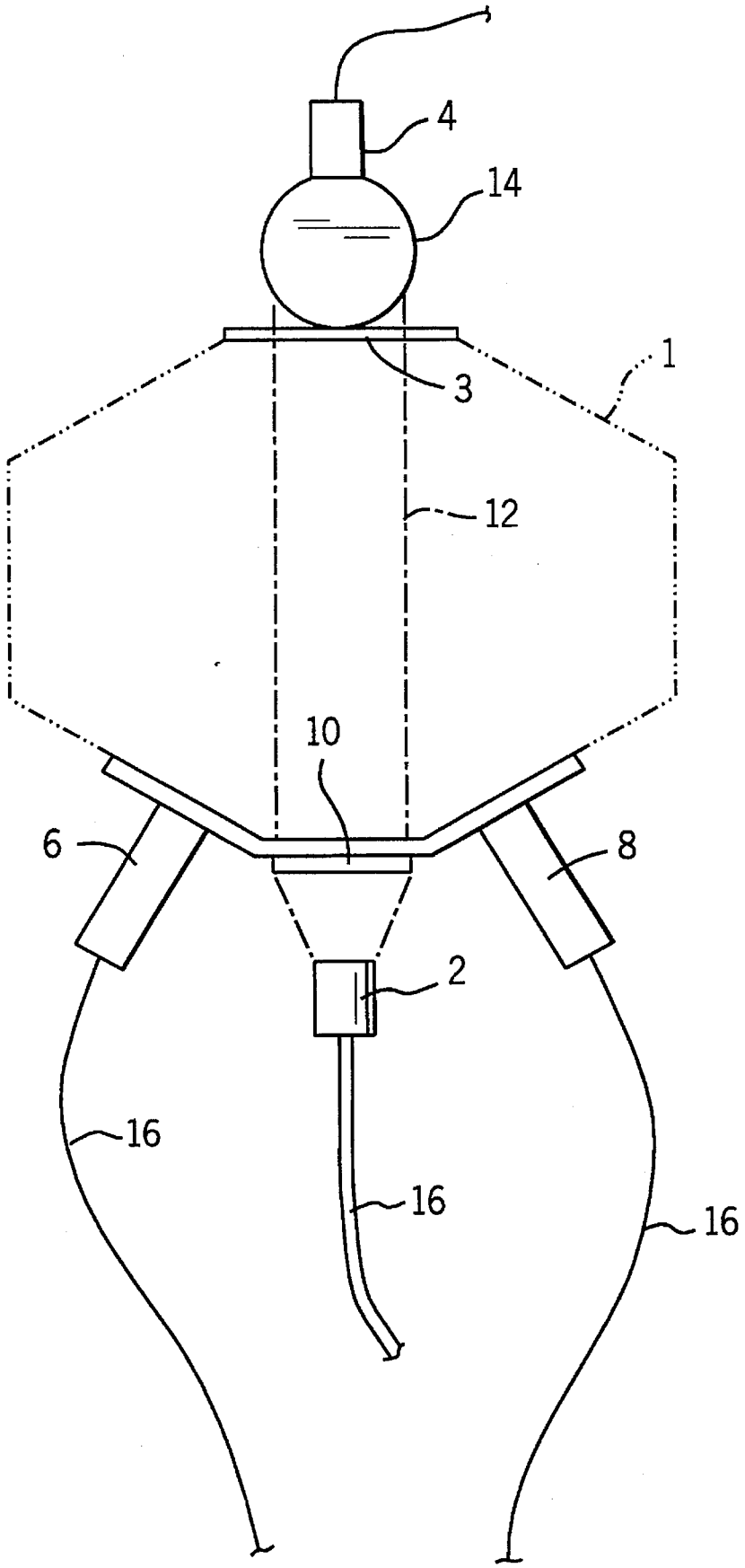
4
14
1
3
12
10
6
8
2
16
16
16

OPTICAL SORTING SYSTEM FOR A COLOR SORTING MACHINE AND PROCESS

FIELD OF THE INVENTION

The invention relates to an optical sorting method and system which separates objects according to their color. In particular, the optical sorting method and system may be used to separate coffee beans or other agricultural products according to color deviations, which often indicate substandard quality.

BACKGROUND OF THE INVENTION

Already known from U.S. Pat. No. 4,799,596 to Mallant (which has a German counterpart in DE 36 14 400) is a color sorting machine in which the product to be sorted is transported through a central duct. The duct is transparent in the area of an observation head. The observation head has, distributed about the duct, several light transmitters in the form of lamps which radiate through the transparent duct. A photocell or photodiode arrangement is arranged next to every lamp as product signal receiver. A background plate lies diametrically opposite the photocell arrangement at the other side of the duct, which plate is chosen according to the color of the product to be sorted. In operation, one transmitter always illuminates the front of the product and a second transmitter the background plate. The product signal and the background signal are recorded by the photocell arrangement and compared with each other. If the product signal corresponds to the background signal, the product has satisfied requirements. However, if the signals differ from each other, an ejector is triggered which discharges the corresponding product out of the product stream.

A disadvantage of the known device and of the process used is that the background plate always has to be physically matched to the product color, so that a large number of background plates with different colors always has to be kept in stock for every product. Moreover, the replacement of the background plates not only takes time but also calls for experience in the choice of the correct color.

It is known from U.S. Pat. No. 4,863,041 to change the background color dynamically for a comparable color sorting machine, by choosing for the background a light source whose wavelength can be changed by an electronic dimmer circuit. Although this relieves the user of the need to replace background plates physically, there remains the problem of sorting out items which do not completely cover the light beam sent out by the transmitter. As a result, the signal yield is only very low and small color deviations can be recognized only with difficulty.

It is known from DE 34 06 599 C2 to conduct product past light transmitters and light receivers so that light is reflected to the light receivers both from the front and from the rear of the product. The light receiver then sees the light of a background transmitter whenever no product is there. Although the transmitters lying next to the light receiver also radiate light, this light is not recorded by the light receiver because of the lack of a reflection area. If good product enters the ray path from the back- ground transmitter to the light receiver, the background radiation is wholly or partly interrupted, but the radiation from the transmitters is reflected onto the light receiver on a wavelength which corresponds to the background radiation. In the case of good product, the message to the light receiver is no different to what it would be were no product present at all. No distinction can thus be made between the presence or absence of good product.

Distinctions are only drawn when bad product crosses the ray path. It is thus not possible to count good product should this be desired for further process control. Nor can any good product be sorted out, which may be desirable for example if, after one or more sorting runs in which good product was separated from bad, inverse sorting is to be carried out, in which only sorted out material is once again fed through the sorting machine in order to sort out the good residual product which is inevitably still contained in it.

Known, finally, from DE 32 03 773 A1 is the use of a ground-glass plate as diffusor in conjunction with an optical color recognition system, for the recognition of the surface of a disc wheel. However, this has nothing to do with product sorting.

Therefore, one object of the invention is to provide an optical sorting system for, say, agricultural products such as coffee beans, peanuts etc. so that color deviations can be reliably recognized even if the product only partly covers the light beam from the transmitter, so that only part of the light quantity sent out is scattered back.

SUMMARY OF THE PRESENT INVENTION

An optical sorting system of the invention for use in color sorting includes a duct through which agricultural products including coffee beans, peanuts, and peas can be transported. An observation head is mounted on the duct, which head includes at least one optical transmitter and at least one product signal receiver arranged next to the transmitter on the same side of the duct. The duct is transparent in the area of the transmitter and of the product signal receiver so that a beam from the transmitter can illuminate an object in the duct and the light reflected back from the object can de detected by the signal receiver. A residual light receiver is arranged on the side of the duct opposite the transmitter in the ray path of the transmitter so that it receives only light sent out from the transmitter, but no light reflected from the product. An optical slot system is arranged between the transmitter and the duct which illuminates the duct stripwise perpendicular to its axis (lengthwise direction).

The foregoing apparatus can be used to carry out a process for the recognition and differentiation of particle-shaped items such as agricultural products and minerals using a color sorting machine. The process involves transilluminating the duct guiding the items with one or more transmitters with light, recording the light scattered back from the item using the product signal receiver, converting the recorded scattered light into a first electrical signal whose amplitude is proportional to the scattered-back light quantity using a product signal processing circuit, recording only light from the transmitter not scattered back by the item using the residual light receiver, converting the recorded non-scattered light into a second electrical signal whose amplitude is proportional to the non-scattered light quantity, and combining the first and second electrical signals in a manner effective to determine a signal maximum and/or signal minimum resulting from the signal combination that is standardized on the basis of the width of the product illuminated by the transmitter beam, which standardized signal maximum or signal minimum can be used as a basis for color sorting.

The quantity of light emitted by the transmitter is either scattered back from the front of a product to one or more product signal receivers and evaluated by them, or only part of the light is scattered back by the product while the remainder falls past the product onto the residual light receiver. In no case, however, is light reflected from the back of the product onto the residual light receiver. If the signals from the product signal receiver and the residual light receiver are now combined, a statement is obtained about the width of the product and the scattered-back signal can be standardized in this way, i.e. made as great as it would have been had the product covered the whole light beam. In this way, a flaw or spot is shown magnified, so that a better distinction between defect-free and defective product is possible.

BRIEF DESCRIPTION OF THE DRAWING

The drawing is schematic sectional view of an optical sorting system of the invention.

DETAILED DESCRIPTION OF THE PREFERRED EMBODIMENTS

In the drawing, only part of the observation head of a color sorting machine is diagrammatically represented, as known from U.S. Pat. No. 4,799,596 to Mallant and incorporated herewith by reference. The drawing shows a section through the duct 1 of the color sorting machine, perpendicular to the transport direction of items or product which drop or are conveyed through the duct 1. In the Mallant patent the duct is called "slide 5", the observation head bears reference numeral "7". Attached to the duct 1 of this invention is at least one transmitter 2 which radiates visible, infra-red or ultra-violet light through the duct 1. In the ray (or beam) path 12 of the light sent out from the transmitter 2 there lies, on the other side of the duct 1, a residual light receiver 4 before which is connected a scatter or collecting element 14. Arranged next to the transmitter 2 on every side is a product signal receiver 6 or 8 whose output signals are guided via light conductors 16 to a signal processing circuit, which is known per se and therefore not shown.

The transmitter 2 is a light source for visible, infra-red or ultra-violet light. In one version, the transmitter 2 is a cold-light source, for example a halogen lamp. The shape of its beam is limited by an optical slot system 10, likewise known per se, to a flat strip which, in one version for example, is 20 to 50 mm wide and 1 to 2 mm high. By "optical slot system" we mean a combination of a slot and an optical lens system which achieves the above criteria for shape of the beam throughout the diameter of the duct 1 or the distance from the slot system 10 to the scatter or collecting element 14, which ranges from 50 to 150 mm. The scatter or collecting element 14, arranged at the opposite side of the duct 1 and outside thereof behind a light-permeable wall section 3, is at least as wide as the light strip (or band) from the transmitter 2, so that the whole quantity of light crossing through the duct 1 from the transmitter 2 falls onto the scatter or collecting element 14 and can be conducted by the latter to the residual light receiver 4. The signals from the residual light receiver 4 are likewise transmitted, for example by light conductors, to a signal processing circuit in which they are opto-electrically converted. In this way, light signals turn into electrical signals whose amplitudes are proportional to the light quantities received.

It is pointed out that the assembly shown in the drawing comprising transmitter 2, residual light receiver 4 and the product signal receivers 6 or 8 can also be repeated around the duct 1 in identical structure, for example offset at an angle of 90 degrees or 120 degrees. If space permits, more than three transmitters with associated residual light receivers and product signal receivers can also be provided.

When using more than one transmitter 2, the triggering of the transmitters 2 should preferably be staggered in time relative to each other, in order that the residual light receiver 4 does not receive scattered light from another transmitter 2 which is reflected from the back of the product. This triggering is effected e.g. by pulsing the light sent through the duct 1, for example by providing in the optical slot system 10 a shutter which opens only at certain times. In this way, only light from a single transmitter ever reaches the opposite-facing residual light receiver at any time.

To sort a specific product, e.g. coffee beans, the wavelength of the light emitted by the transmitter 2 is firstly chosen to match the color of the product and set via a control apparatus, not shown. The sensitivity of the product signal receivers 6 and 8 is also set to the desired wavelength range which corresponds to the wavelength of the radiation scattered back by the product. Product can then be transported through the duct 1 perpendicular to the drawing plane. If there is no product in the ray (or beam) path 12, all the light from the transmitter 2 is transmitted to the residual light receiver 4 and collected by the latter. The first electrical signal derived therefrom then has the maximum amplitude and maximum width (time duration). On the other hand, if there is product in the ray path 12, part of the light is scattered back from the product to the product signal receivers 6 and 8. The scattered-back (reflected) light is conducted as a light signal via the light conductors 16 to a transducer circuit, not shown, in which it is converted into second electrical signals. The width (time duration) of the scattered-back second signals is a measure of how much light from the transmitter 2 was scattered back and corresponds to the size of the product. The amplitude of the second electrical signals allows a conclusion to be drawn concerning the color of the product, with the peak or maximum of the signal amplitude corresponding to the main color of the product, while minima indicate the presence of spots or defective points. The second electrical signals originating in the scattered-back light can be standardized by normal signal processing and thus brought to a maximum value, so that wells or minima which indicate defective points are magnified as much as possible. These minima can then be used, when a specific level is exceeded, to trigger other components. This happens, for example, through a per se known discriminator circuit which, whenever a minimum reaches lower than a pre-set threshold value voltage, outputs a pulse which controls an ejector, not shown. The ejector, for example an air jet, can discharge the defective product, a compressed-air valve being triggered by the control pulse.

According to the invention, the residual light receiver 4 can always recognize whether product is present or not. Its signal can also be evaluated so that the product signal is always brought, according to the size of the product passing through the light barrier, to a standard value which corresponds to a state as if the product always had the same size. In this way, the total of residual light+reflected light is always constant for good product, regardless of how large the product appears when passing through the measurement section. Deviations in product color or spots can thus be much better defined than is the case with the prior art.

We claim:

1. An optical scanning device used in a sorting system for use in color sorting, comprising:

a duct through which particle-shaped agricultural and mineral products can be transported;

an observation head mounted at one side of the duct, which head includes at least one optical transmitter and at least one product signal receiver arranged next to the transmitter on the same side of the duct, the duct being transparent in the area of the transmitter and of the product signal receiver;

a residual light receiver arranged at the side of the duct opposite the transmitter in the ray path of the transmitter so that it receivers only light sent out from the transmitter, but no light reflected from the product; and an optical slot system arranged between the transmitter and the duct which illuminmates the duct stripwise perpendicular to its axis in the form of a flat strip of light.

2. The optical sorting device according to claim 1, wherein the residual light receiver includes a photodiode.

3. The optical sorting system according to claim 1, further comprising a light collecting element arranged in the ray path between the transmitter to the residual light receiver between the duct and the residual light receiver.

4. The optical sorting system according to claim 2, further comprising a light collecting element arranged in the ray path between the transmitter to the residual light receiver between the duct and the residual light receiver.

5. The optical sorting system of claim 1, wherein a pair of product signal receivers are arranged on each side of the transmitter.

6. The optical sorting system according to claim 1, wherein the receivers are adjustable to different wavelengths.

7. The optical sorting system of claim 4, wherein a pair of product signal receivers are arranged on each side of the transmitter.

8. The optical sorting system according to claim 7, wherein the receivers are adjustable to different wavelengths.

9. The optical scanning device of claim 1, wherein the slot system produces a flat strip of light from 20 to 50 mm wide and from 1 to 2 mm high.

10. The optical scanning device of claim 3, wherein the distance from the slot system to the light collecting element is from 50 to 150 mm.

11. The optical scanning device of claim 10, wherein the slot system produces a flat strip of light from 20 to 50 mm wide and from 1 to 2 mm high.

12. A process for scanning particle-shaped items using an optical scanning device, comprising:

transilluminating a duct configured for conveying agricultural and mineral products, which duct guides the items, with a flat strip of light from one or more transmitters;

recording the light scattered back from each item using a product signal receiver;

converting the recorded scattered light into a first electrical signal whose amplitude is proportional to the scattered-back light quantity using a product signal processing circuit;

recording only light from the transmitter not scattered back by the item using a residual light receiver;

converting the recorded non-scattered light into a second electrical signal whose amplitude is proportional to the non-scattered light quantity;

combining the first and second electrical signals to determine a signal maximum of signal minimum resulting from the signal combination that is standardized on the basis of width of the product illuminated by the transmitted light, which standardized signal maximum or signal minimum can be used as a basis for color sorting.

13. The process of claim 12, wherein the items are agricultural products.

14. The process of claim 12, wherein the items are mineral products.

15. The process of claim 13, wherein the items are selected from the group consisting of coffee beans, peanuts and peas.

16. The process of claim 12, wherein the strip of light is from 20 to 50 mm wide and from 1 to 2 mm high.

* * * * *